United States Patent [19]

Hagemeister

[11] Patent Number: 4,632,182

[45] Date of Patent: Dec. 30, 1986

[54] HEAT EXCHANGER FOR GASES OF GREATLY DIFFERENT TEMPERATURES

[75] Inventor: Klaus Hagemeister, Munich, Fed. Rep. of Germany

[73] Assignee: Motoren- und Turbinen-Union Munchen GmbH, Munich, Fed. Rep. of Germany

[21] Appl. No.: 548,001

[22] Filed: Nov. 2, 1983

[30] Foreign Application Priority Data

Nov. 19, 1982 [DE] Fed. Rep. of Germany ..... 3242845

[51] Int. Cl.[4] ..... F28F 9/02

[52] U.S. Cl. ..... 165/173; 165/176; 285/137.1

[58] Field of Search ..... 165/173, 175, 176; 285/137 R

[56] References Cited

U.S. PATENT DOCUMENTS

| | | | |
|---|---|---|---|
| 2,488,627 | 11/1949 | Hisey | 165/151 |
| 2,705,616 | 4/1955 | Watson | 165/175 X |
| 2,930,590 | 3/1960 | Sartori et al. | 165/175 X |
| 3,245,465 | 4/1966 | Young | 165/173 X |
| 3,885,936 | 5/1975 | Limebeer | 165/172 X |
| 4,040,476 | 8/1977 | Telle et al. | 165/76 |
| 4,286,654 | 9/1981 | Ruhe et al. | 165/172 |

*Primary Examiner*—Albert W. Davis, Jr.
*Assistant Examiner*—Peggy Neils
*Attorney, Agent, or Firm*—Barnes & Thornburg

[57] ABSTRACT

A heat exchanger as well as a method of manufacturing the same, in which the heat exchanger bottom is constructed thermo-elastically flexible in a layered manner of construction taking into consideration the rigidity requirements thereof; each layer has two complementary sheet metal shells which are equipped with predeformations for the connections or enclosure of matrix profile ends as well as for the mutual joinability of the layers.

23 Claims, 23 Drawing Figures

HEAT EXCHANGER FOR GASES OF GREATLY DIFFERENT TEMPERATURES

This invention relates to a heat exchanger and to a method for manufacturing a heat exchanger for gases of greatly different temperatures where a cross/counterflow matrix to be exposed to a hot gas stream comprises a plurality of tubes, more particularly of spear-shaped formed to promote flow in the direction taken by the hot gas, the tubes being connected to at least one tubesheet which forms part of a tubular head designed to permit the entry and/or exit of a medium, that is, air under pressure, to or from the matrix.

Disclosed in DE-OS No. 29 07 810 is a heat exchanger, the hot gas wetted cross/counterflow matrix of which consists of separate tubes or spear-shaped tubular shapes connected at the one end to a first stationary head, which permits compressed air to be introduced into the respective matrix ducts, and at the other end to a second starionary head, which permits the compressed air heated by the matrix to be ducted to a consumer. In this arrangement the two separate heads can be integrated into a common collective tube or they can be formed by essentially parallel individual tubes arranged side by side. In a preferred arrangement of the heat exchanger, the respective compressed air ducts, comprised for example by tubes, tubular shapes and the like, project laterally in U-fashion from the respective collective tubes.

In other heat exchanger configurations, however, the hot gas wetted matrix formed by the tubes or tubular shapes conceivably does not project laterally in U-fashion; rather, the respective tubes or tubular shapes of the matrix communicate with an air inlet tube and, at the other end, issue into a deflecting collective tube, where at the one end of the remaining portion of the matrix, which is formed by the tubes or tubular shapes, immediately reconnected—after deflection—to the collective tube on the exit side and connects at the other end to another tubular head, through which the heated compressed air can be routed to the respective consumer.

With the heat exchanger configuration as described, great difficulty is found in anchoring or rooting the tubular matrix shapes or tubes to the respective tubesheet. A much discussed process attempting to weld or braze the respective matrix tubes to the tubesheet does not satisfy the requirements regarding the operationally desirable strength of the matrix structure while still ensuring an optimally sealed condition, especially so with a view to the markedly different temperature loads caused by, for example, transient operating conditions of a turbomachine, or of a gas turbine engine, so that stresses in the material will result. In long service, such conditions cause cracking in the area of transition between the respective tubular shape and the tubesheet in view of the fact that the respective matrix rim area of the heat exchanger is expected to follow variations in gas and air temperatures much faster than the remaining tube portion, where the surface area available for the transfer of heat is substantially larger.

In the manufacture of the previously discussed heat exchanger configuration, a need exists for extremely precise prefabrication of the ports in the heat exchanger tubesheet or tubesheets to enable the insertion of the tubes or tubular shapes into the tubesheets, where, in proper adaptation to the plurality of these holes, the ends of the tubes or tubular shapes must be adapted with a commensurate amount of precision to enable assembly, especially with a view to producing preferably narrow and uniformly sized brazing gaps, so that in the subsequent operation of joining the matrix structure to the tube sheet, locally different deposits of brazing alloy are precluded and will neither cause a poor joint nor create leakage.

In a broad aspect, the present invention provides an optimum connection, tube-to-tubesheet, as regards strength and sealing integrity in the face of varying temperature effects. A heat exchanger results for which the matrix connecting area or tubesheet for the tubes or tubular shapes is manufactured with relative ease by joining it together in modular fashion suitable for large-scale production, with temperature and strength requirements still being satisfied.

The heat exchanger construction of the present invention provides in a comparatively simple manner positive anchorage and attachment of the tube, or tubular shape ends, of the matrix to the tubesheet where, advantageously, the need for extremely precise preforming of relatively closely toleranced ports in the tubesheet is eliminated. The partial replacement of damaged structural elements of the tubesheet is facilitated by the invention.

A further substantial advantage of the present invention is afforded by the tubesheet being thermoelastically flexible, which characteristic will largely prevent the buckling of tubular shapes caused by different temperature gradients. The optionally varied design of the tubesheet structure of the present invention also makes for optimum aerodynamic inlet flow conditions for the medium to be preheated, for example, compressed air, from a collective tube, or from the tubesheet inner side into the respective tubular shapes of the matrix.

It is a particular object of the present invention to provide method and apparatus for a heat exchanger for gases of greatly different temperatures wherein the cross and counterflow matrix to be exposed to the hot gas stream comprises a plurality of tubes, more particularly of spear-shaped tubular shapes formed to promote flow in the direction taken by the hot gas, the tubes being connected to at least one tube sheet which forms part of a tubular head designed to permit the entry and exit of a medium to and from the matrix wherein at least one tube sheet is comprised of various layers, each layer being associated with a certain row of heat exchanger matrix shapes extending in a first direction of the layer, each layer comprising two complementary sheet metal shells, the sheet metal shell being preformed locally at least such that when joined together to form a layer, they form one of a group of matrix profile connections and a group of matrix hollow profiles, the sheet metal shells of a layer enclosing between themselves recesses on the inner side of the tube-sheet that extend symmetrically with the respective row of matrix shapes.

It is another object of the invention to produce a heat exchanger wherein the respective outer wall sections adjoining matrix shaped depressions of two sheet metal shells are designed for attachment, one to the other, and also for retaining and orienting the locally entering or connecting ends of the matrix shapes.

It is another object of the invention to provide heat exchanger wherein the metal sheet strips or shells are provided with suitable surface contours such as pimples, corrugations or laps to provide increased structural strenth and increased service requirements of thermal transmission.

It is another object of the invention to provide a method for manufacturing a heat exchanger wherein the matrix shapes are brought into their proper positions, the bottom ends are enclosed by associated suitably contoured depressions of sheet metal shells, parts are pressed together and bonded at their mating lateral surfaces at at least the outer wall sections and individual layers are assembled arranged in rows wherein the rows are bonded together at the mating inner wall sections.

It is another object of the invention to provide a heat exchanger wherein inner wall sections of respective sheet metal shells of layers have a periodically angled joining contour in the immediate vicinity of respective matrix shape end areas.

It is another object of the invention to provide a heat exchanger wherein layers extend in screw-thread fashion in accordance with a circumference of a container shell, the inner wall sections of the layer repeating themselves thread for thread arranged side by side and joined together to form a container shell.

It is another object of the invention to provide a heat exchanger wherein a heat exchanger tubesheet forms part of a pressure vessel wherein the hydraulic forces of an end cover of the vessel are absorbed by a rod framed construction and the wall of a separate heat exchanger housing.

It is another object of the invention to provide a heat exchanger wherein a cross/counterflow matrix for hot gas streams is comprised of separate spear-shaped tubular shapes connected at one end to a first stationery tubular head for the introduction of a medium into the respective matrix ducts and at the other end to a second stationery tubular head for carrying the compressed air heated by the matrix to a consumer wherein the two separate heads are integrated into a common collective tube or are formed by essentially parallel individual tubes arranged side by side and wherein the heat exchanger matrix or its respective compressed ducts project laterally in U-shaped fashion from the respective tubes.

These and other objects, features, and advantages of the present invention will become more apparent from the following description when taken in connection with the accompanying drawings which show, for the purposes of illustration only, several embodiments in accordance with the present invention, and wherein.

Figure 15:
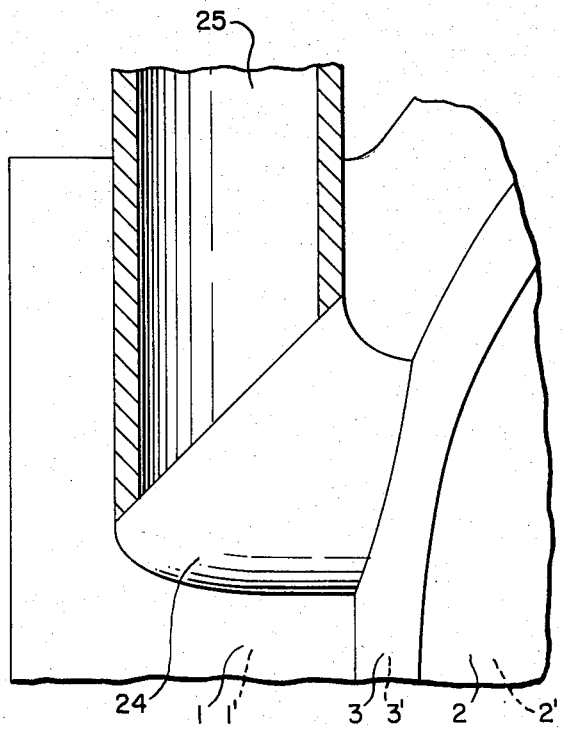
FIG. 15 shows a configuration wherein a hollow shape is caused to enter the tubesheet at an angle.
Figure 15A:
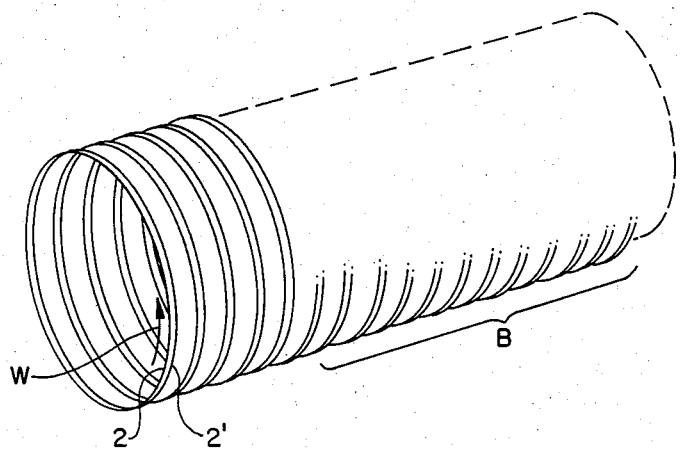

FIG. 15*a* shows an embodiment of the invention employing layer-wise construction wherein the respective layers extend helically over the circumference and casing of a container.

Figure 16:
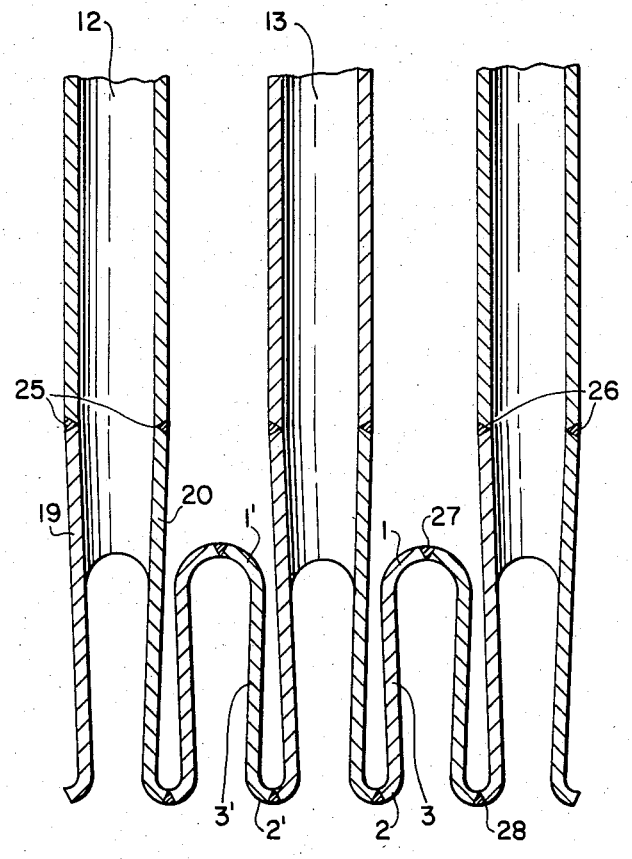

FIG. 16 is a sectional view of a further embodiment of the invention wherein individual parts are joined by butt welds.

Figure 17:
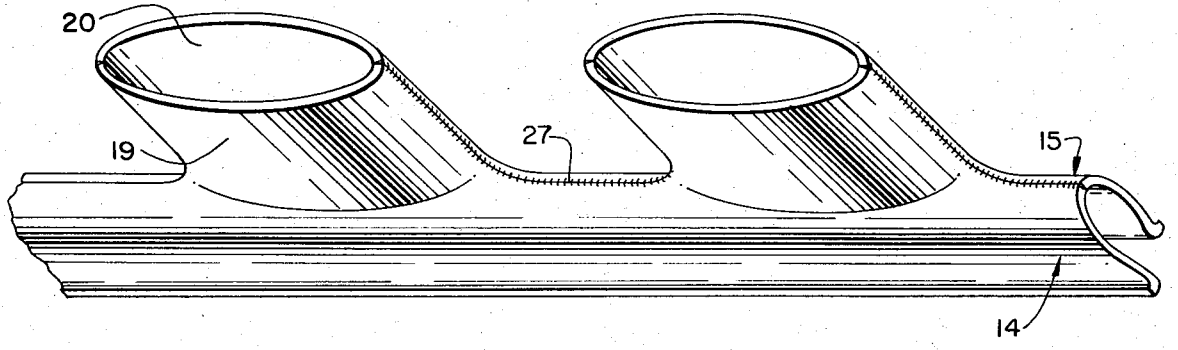

FIG. 17 is a perspective view of the weld structure of FIG. 16.

Figure 18:
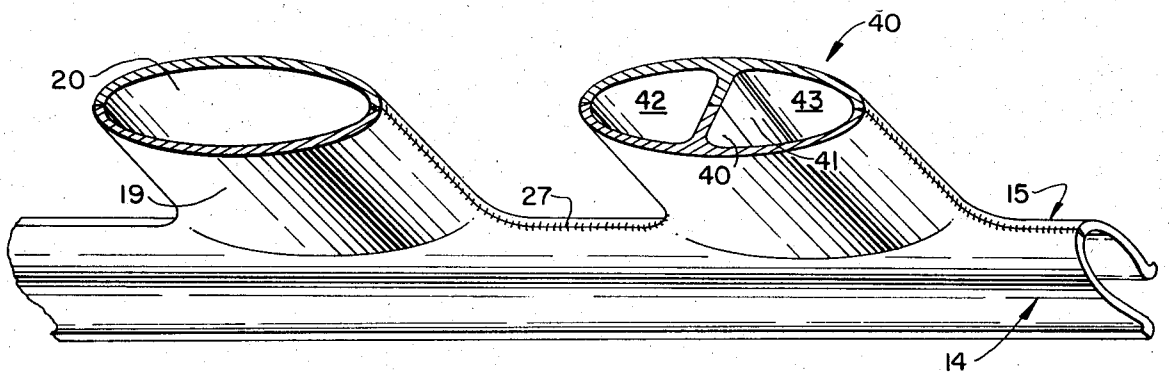

FIG. 18 shows another embodiment of the invention wherein a spear-shaped tube has an inner wall.

Figure 19:
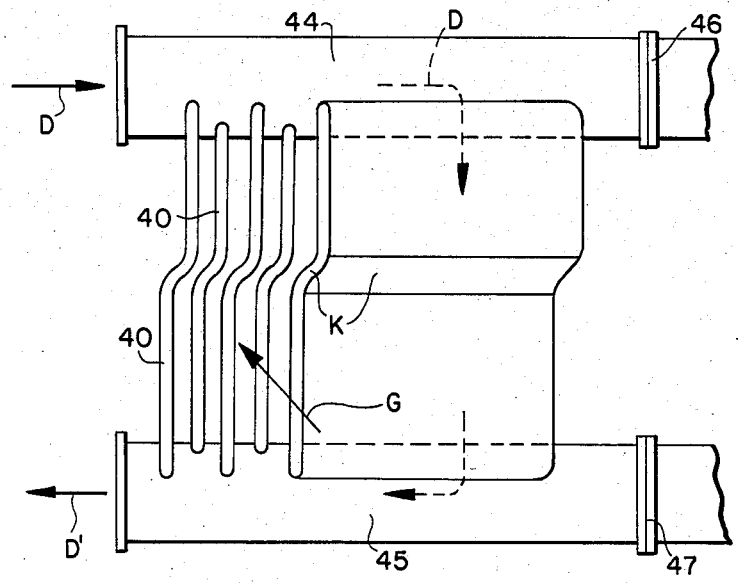

FIG. 19 shows a further embodiment of the invention wherein tubular shapes of a matrix are given a bend at a point preferably midway between the tube heads for adding flexibility.

Figure 20:
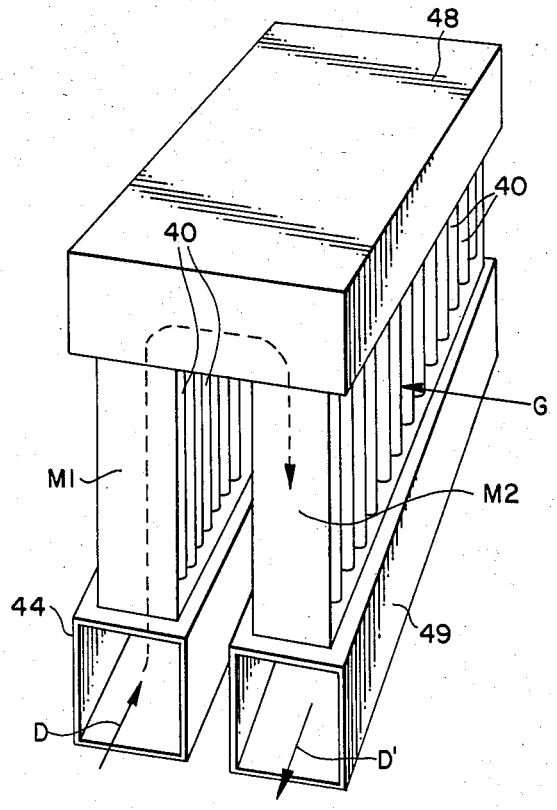

FIG. 20 shows another embodiment of the invention having box-shaped tube heads and plural matrices.

Figure 21:
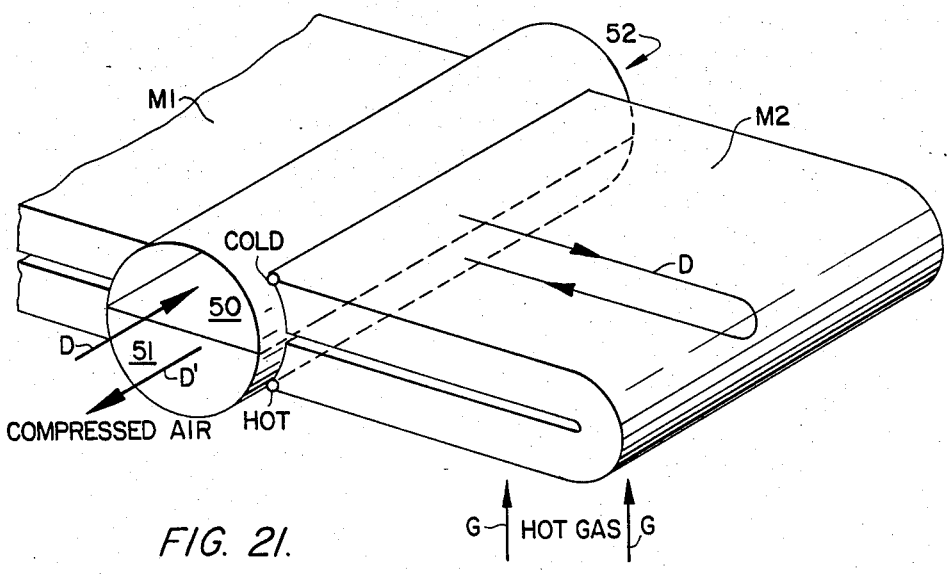

FIG. 21 shows a further embodiment of the invention employing plural matrices of separate tubes, two separate heads being integrated into a common collective tube with tubular shapes projecting laterally in U-fashion from a common collective tube.

Figure 22:
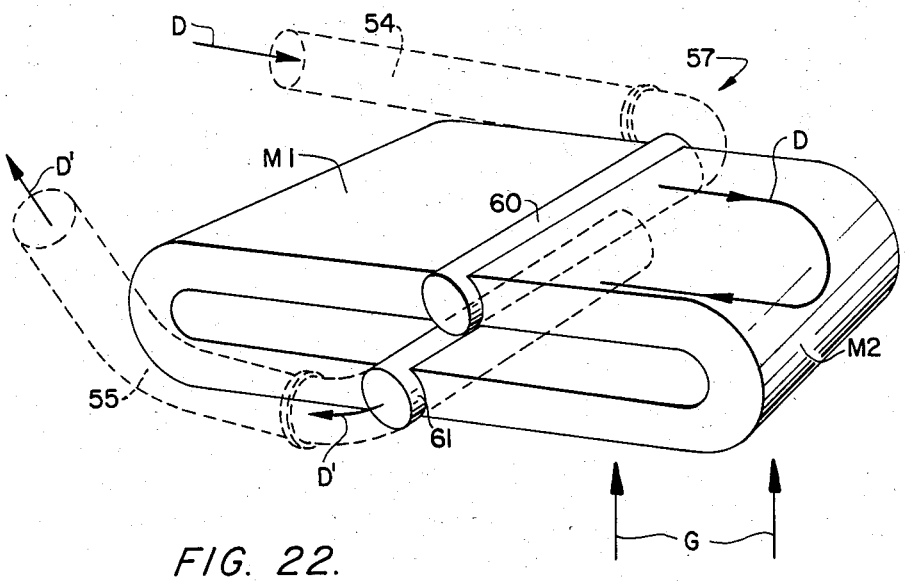

FIG. 22 shows a further embodiment of the invention wherein two separate parallel tube lines are used in view of a single collective tube.

Figure 1:
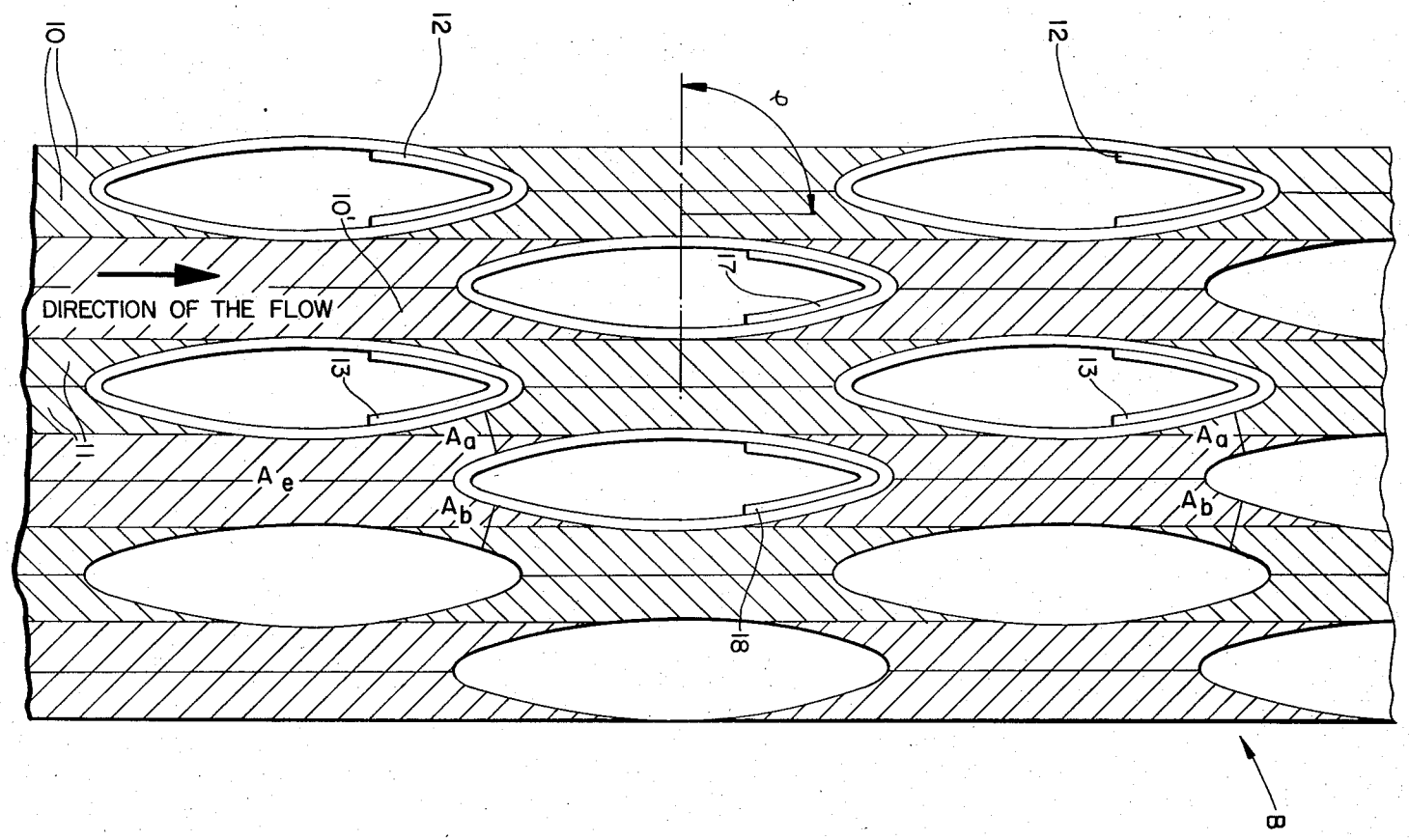
FIG. 1 shows a first embodiment of the invention comprising tubes of spear-shaped cross section in matrix array.

With reference to the drawings wherein like reference numerals represent like elements, and more particularly with reference to FIG. 1, the present invention comprises an array of rods and tubes or tubular shapes, or tubes of spear-shaped cross section such as 12, 13, structured such that successively disposed tubular shapes in the array are related to a layer 10 or 11. The tubesheet to locate and coordinate the tubular shapes, such as 12, within a layer 10 consists of two complementary strip-shaped sheet metal shells 14, 15, FIGS. 2 and 3, locally contoured such that they embrace the roots of the tubular shapes of a layer 10 with their depressed portions 19, 20 as seen from FIGS. 4 and 5.

FIG. 1 illustrates the basic principle by way of an array of spear-shaped heat exchanger tubes and the stratified arrangement 10, 10', 11, shown as alternating shaded portions, in the practice of the present invention.

Figure 2:
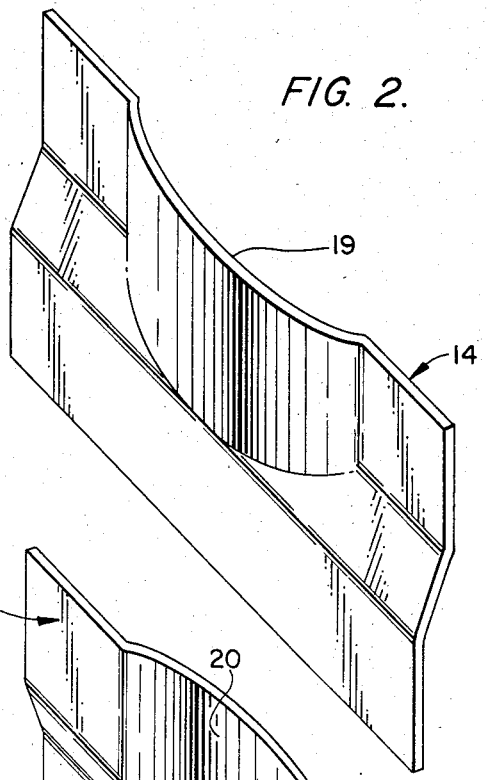
FIGS. 2 and 3 shows complementary sections of the strip-shaped sheet metal shells employed in the embodiment of FIG. 1.
Figure 3:
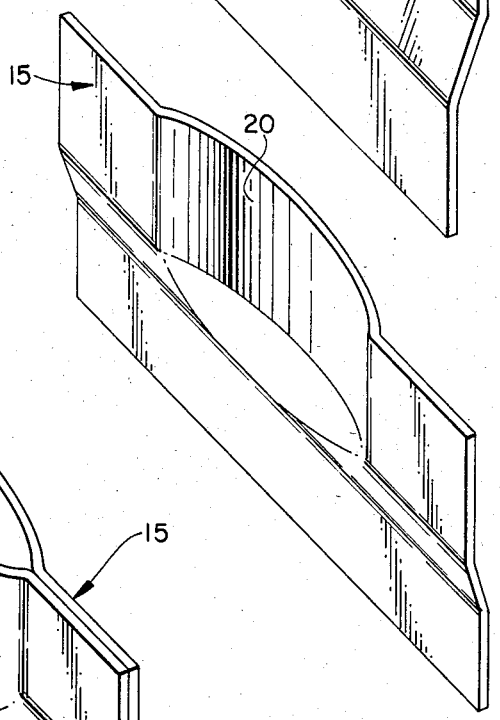

FIGS. 2 and 3 illustrate complementary sections of the strip-shaped sheet metal shells 14, 15, which when joined together embrace the roots of the spear-shaped tubular shapes 12 of FIG. 1 with their corresponding local contour 19, 20.

Figure 4:
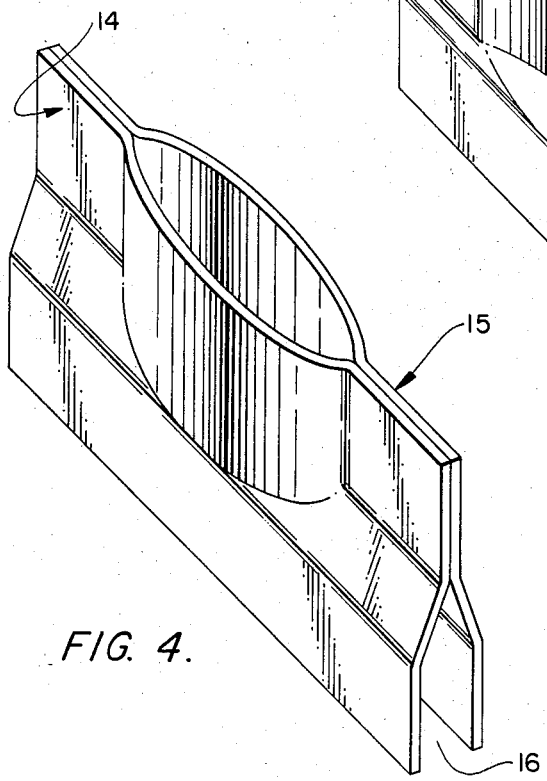
FIG. 4 shows an assemblage of strip-shaped sheet metal shells of the embodiment of FIG. 1.
Figure 5:
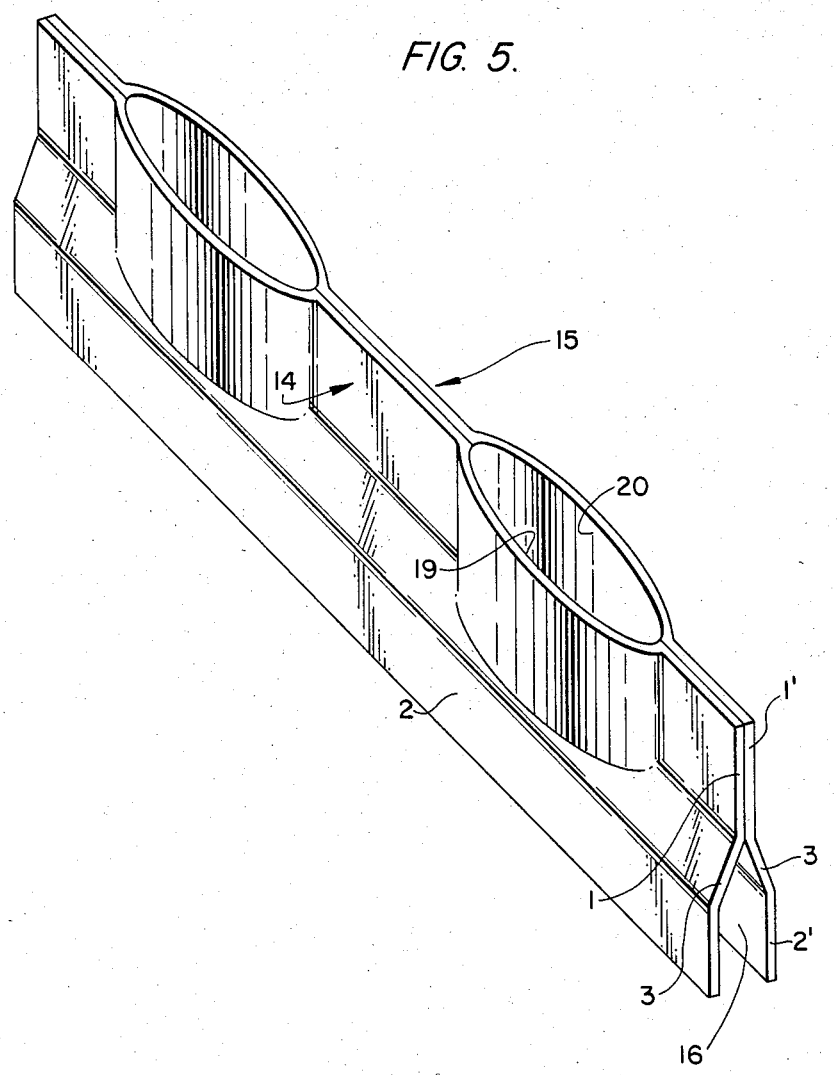
FIG. 5 shows an assemblage of strip-shaped sheet metal shells with a transitional section and a lower wall section.

The combination formed in this manner, and shown in FIGS. 4 and 5 in the absence of the spear-shaped tubular shapes 12 of FIG. 1 forms the fundamental element which is combined with others to form a layer of the tubesheet of the present invention.

FIG. 5 illustrates the assembly of these elements in a length direction of the layer. Seen vertically the layer can be differentiated into various sections 1, 1'; 2,2', 3,3', which may serve different functions. The upper wall section 1,1' serves to locate and position the locally entering tubes or tubular shapes. The lower wall section 2,2' provides the mating surface with an adjacent layer by its outer side wall. It is also designed to absorb longitudinal or bending stresses resulting from the service loads imposed on the tubesheet, the structure of which is formed by the layers. Arranged between these two is a transitional section 3,3', which represents the spatial width of the layer composed of two sheet metal strips. Shape and profile of the section 3,3' can be varied to affect the stiffness of the structured tubesheet and the absorption and transfer of load especially in the width direction of the tubesheet.

The forming operations for the sheet metal strips or shells can be used to impress into the surface any desirable contours or relief-type profiles in the form of, such as pimples, corrugations or laps to adapt the local properties of the structure in terms of structural rigidity to satisfy the requirements of manufacture and service.

The components are joined together to form a layer assembly such that the tubes or tubular shapes 12 associated with the layer are brought into position and that the roots of the tubes or tubular shapes are then enclosed by the suitably preformed sections 19, 20 of the complementary sheet metal strips. Suitable forming tools are then used to press the members snugly together and unite them at their mating surfaces by a bonding process, such as welding, brazing or diffusion bonding.

Figure 6:
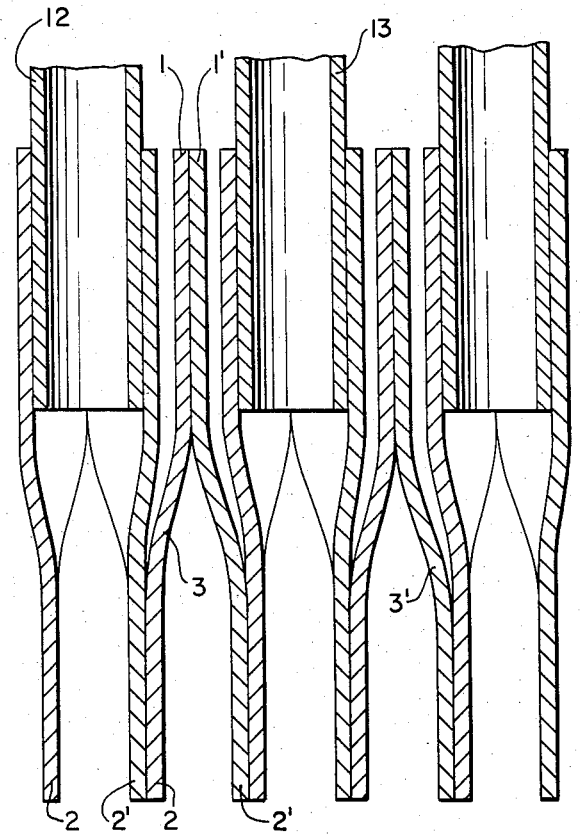
FIG. 6 shows a cross section view of the strip-shaped sheet metal shells of the embodiment of FIG. 1.

The layers assembled in this manner are then arranged side by side such that the tube or tubular shape array—as exemplified in FIG. 1—results. Viewed in cross section the layers will then be aligned side by side, as shown in FIG. 6, such that the outer surfaces of the sections 2,2' will abut one another. These surfaces are then united by a bonding process to form the tubesheet of the array of tubes or tubular shapes.

Figure 7:
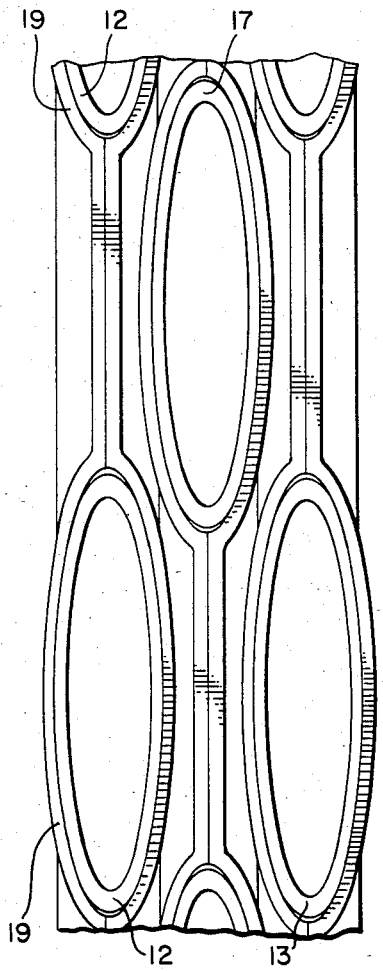
FIG. 7 shows a detailed portion of the resultant tubesheet viewed from the array of tubes.

FIG. 7 illustrates a detailed portion of the resultant tubesheet viewed from the array of tubes or tubular shapes 12, 13 and 17 enclosed by preformed sections such as 19.

Figure 8:
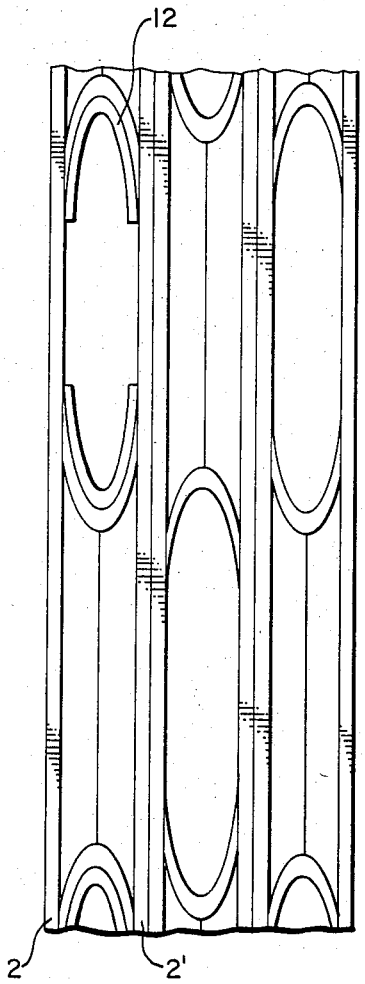
FIG. 8 shows the opposite side of the configuration of FIG. 7.
Figure 9:
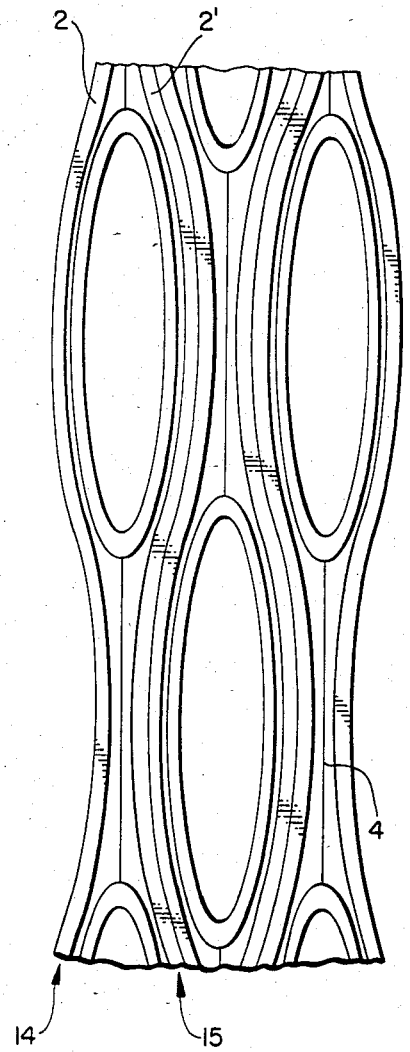
FIG. 9 shows a corrugated profile for the sheet metal strips.

FIG. 8 illustrates the opposite side of this configuration. For tube or tubular shape exchangers, a flow medium, such as compressed air, is directed from a side of the tubesheet structure, which represents the container wall, to the internal cross sections of the matrix. To promote the incoming flow it may be helpful to give the lower wall sections 2,2' of the sheet metal strips a corrugated profile as shown in FIG. 9. This may affect the longitudinal and flexural rigidity of the lower wall sections 2,2'. Bridging the gap at point 4 of FIG. 9 may combat static instability if present in the face of service forces.

Figure 10:
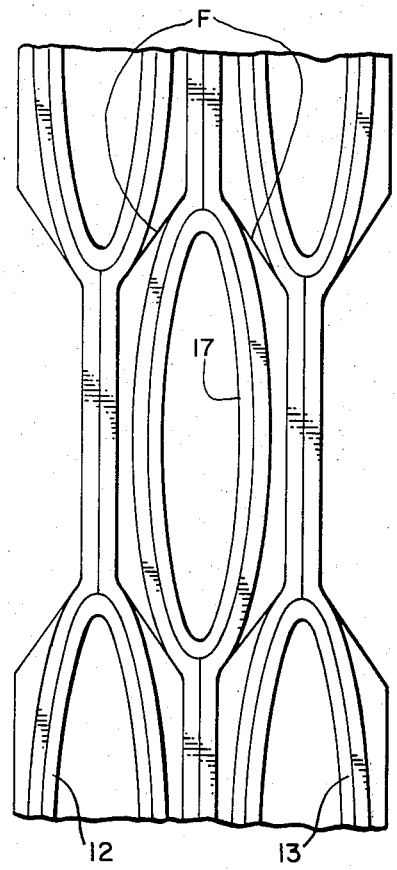
FIG. 10 shows a profile of FIG. 1 wherein gaps show a periodically bent contour.

FIG. 10, as viewed from the profile of FIG. 1, illustrates a further representation of a structured tubesheet in accordance with the present invention. The joints F show a periodically bent contour.

Figure 11:
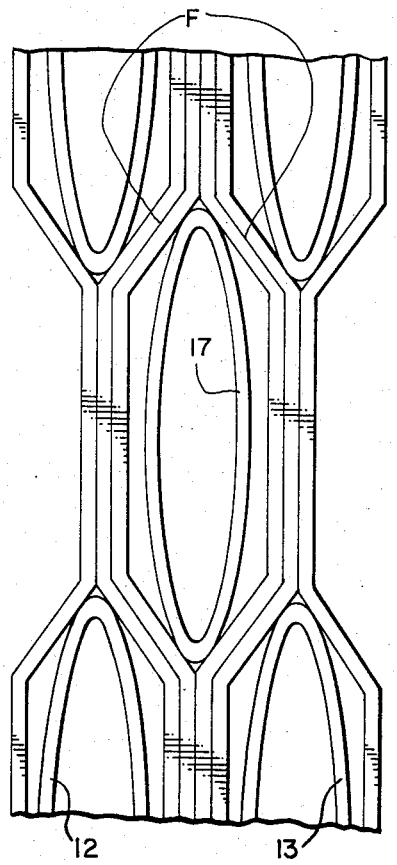
FIG. 11 shows a rear view seen from the inner side of the tubesheet.
Figure 12:
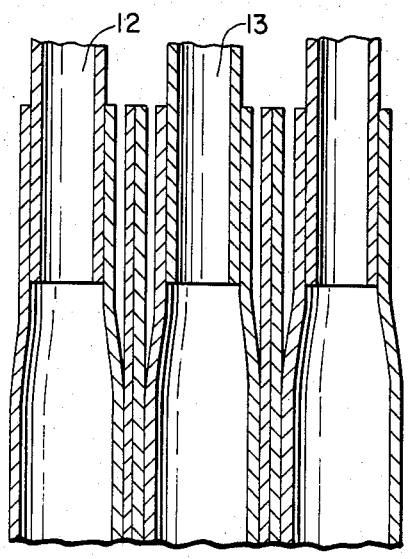
FIG. 12 is a sectional view of the configuration of FIG. 11.

FIG. 11 is a rear view, seen from the inner side of the tubesheet, and FIG. 12 is a sectional view of the configuration of FIG. 11.

Figure 13:
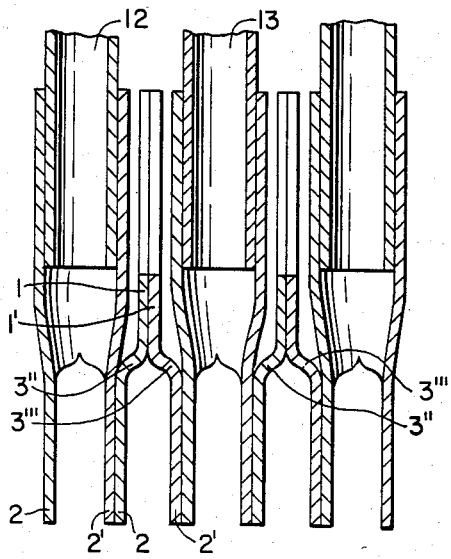
FIG. 13 is a cross sectional view of a second embodiment of the invention in which transitional sections are shorter than those shown for FIG. 5 or FIG. 6.

FIG. 13 is a cross-sectional view of a variant embodiment of the invention, in which the transitional sections 3'', 3''' are shorter than as shown in FIG. 5 or FIG. 6. The webs 1, 1', see FIG. 14, of each upper section are here shown with cutouts 23. producing a configuration which affects the thermal expansion behavior of the structure and reduces the rigidity of the upper wall sections to alleviate the undesirable transfer of stresses in this area.

Use can also be made, although this is not shown in the drawings, of reinforcing flanges incorporated in critical areas, for example, on the inner radii of the cutouts or on their lower edge installed at the time the sheet metal strips or shells are formed.

Figure 14:
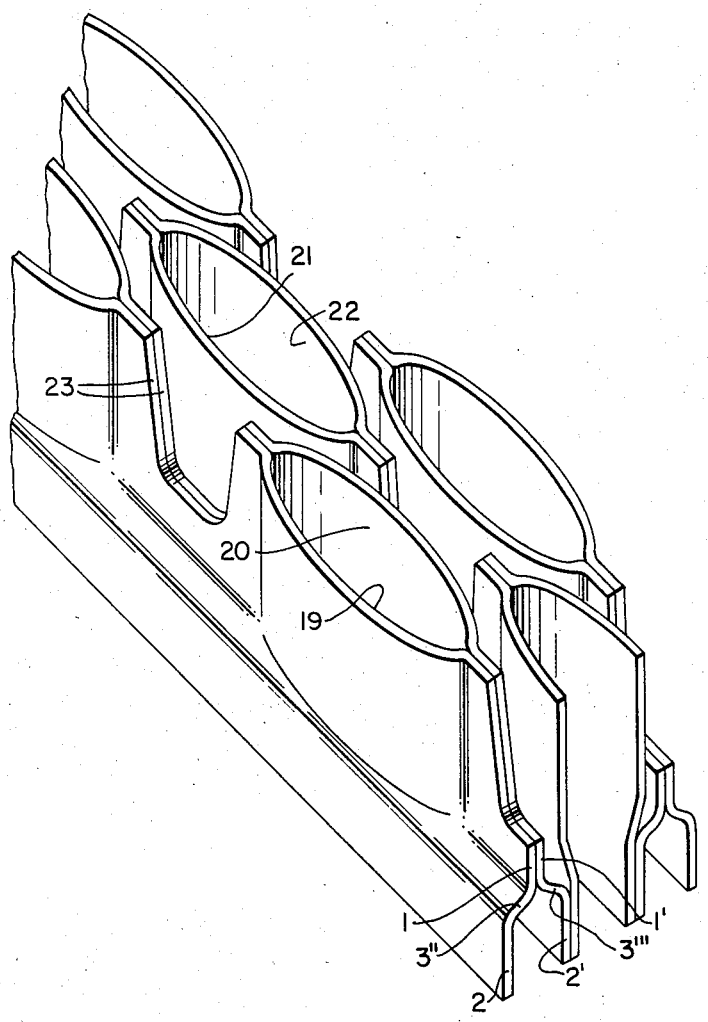
FIG. 14 shows a perspective view of the tubular sections as assembled by joining layers.

FIG. 14 illustrates the variant of FIG. 13 to show how the structure of the tubesheet is formed by joining the layers together. The tubehseet so formed, by joining layers together, may be flat or curved, depending on the general form of the container or component of which it forms a part. A flat tubesheet is formed by straightline layers, and a curved tubesheet by layers following the intended curvature.

Each layer may be part of a frame having a closed circumference. By joining the layers together, a container is formed, the circumference of which is represented by the frame. This frame may be cornered or circular in shape. In the latter case the layers when joined together will make a round container shell.

The circumference of such a frame may be fitted with tubes or tubular shapes only partially. Sections 1,1' of the layers not fitted with tubes or tubular shapes will then exhibit a closed profile, but may be structured in relief-fashion to affect the rigidity profile of the overall structure in an optimum manner.

A suitable design, especially of the upper wall sections 1,1' of the strips or shells, can be used to have the connectors of the tubes or tubular shapes enter the layers at an angle other than 90°.

FIG. 15, shows a configuration wherein a hollow shape 25 enters the tubesheet by way of associated connector 24.

According to FIG. 15*a*, a layer-wise construction may be the basis for the bottom structure, as for example explained hereinabove and illustrated in FIGS. 6, 12 and 13 in cross section. According to this Figure, the layer-wise construction of the bottom structure therefor takes place in such a manner that the respective layer extends helically over the circumference and casing of a container by means of the lower wall sections 2,2' and the lateral flanks of the layers thus repeat themselves pitch-by-pitch and are located adjacent one another or can be adjoined one to another for achieving the container casing B. The respective winding direction is indicated in FIG. 15*a* with W, whereby the lower wall sections 2, 2' of the layers are indicated for the sake of simplicity only as dash contour. The layer configuration has in FIG. 15*a*, at the beginning, a comparatively large axial spacing which however, is chosen thereat only for making clear the helically shaped configuration. Actually, one would have to start from the fact that the respective lower wall sections 2, 2' of the layers are located following closely one another and according to B so form the casing of the container in the further function of a heat-exchanger pipe as can also be seen from FIG. 19 according to reference numerals 44 or 45.

In the case of a closed container.wall the lower wall sections 2, 2', which project inwards in web-fashion, can be joined together by jointly fusing the inner rim of two each adjacent wall sections 2, 2' to be joined.

From FIGS. 6 and 13 it will be apparent that joining the layers together produces a structure that is flexible over its width. This structural flexibility can be utilized for example to compensate for thermal expansion in the length direction. It will also be apparent that this structure should be maximally free from longitudinal tensile stresses, such as may be caused by the end cover of a pressure container.

In a case, therefore, where the wall formed by the structure of the present invention should form part of the shell of a pressure container, the hydraulic forces of the end cover should be absorbed by a special supporting structure. This may be a frame construction formed by rods, or it may be the wall structure of a heat exchanger housing, which may be needed anyway.

FIG. 16 is a sectional view and illustrates a further embodiment of the present invention wherein the individual parts are joined together by no means other than butt welds 25, 26 or 27, 28.

FIG. 17 illustrates the course of the weld 27 to join two complementary strip-shaped sheet metal shells 14, 15 to form a layer, this being a butt weld. The structure of the layer formed in this manner is joined to the adjacent layers again by a butt weld 28, FIG. 16, which bridges the gap between the lower lateral connecting lips. At this point the joint can be deliberately broken at some later time when need arises, for example, to repair individual members of the structure.

In the upper section of the structured layer formed by joining together two complementary sheet metal shells 14, 15 connecting ports are formed to which, as in the case of FIG. 17, the spear-shaped tubular shapes 12, 13 can be connected by, again, butt welds 25, 26, as illustrated in FIG. 16.

As shown in FIG. 18, the upper wall sections of each complementary sheet metal shell of a layer can be designed in length and form of the profile depressions such that joining the two sheet metal shells 14 and 15 of a layer together will simultaneously produce the tubular shapes 40 of the matrix in their finished, preferably spear-shaped form. FIG. 18, therefore, essentially signifies only that in departure from FIG. 7, the preformed matrix shape connectors 19, 20 simultaneously provide the spear-shaped, operationally hot gas wetted tubular shapes 40 of any desirable length. FIG. 18 also illustrates that the inner walls of the matrix shape connectors 19, 20 can exhibit web components 40, 41 which when joined together to form the tubular shape 40, produce two separate compressed air ducts 42, 43. The two web components 40, 41 can be welded or brazed together along the common abutting edges.

In FIG. 19, the tubular shapes 40 of the matrix can be given a bend K at a point preferably midway between the two tube heads for added bending flexibility, especially considering the two-sided entry and attachment of the shapes between tube heads 44, 45. In this arrangement the one tube head 44 serves to supply compressed air D into the tubular shapes 40 of the matrix to be preheated, the shapes being wetted by a stream of hot gas G. The resultant preheated compressed air then flows from the tubular shapes 40 into the tube head 45 to be routed from there to a suitable consumer in the direction of arrowhead D'. FIG. 19 also shows the tube heads 44 and 45 to be sealed by covers 46 and 47 at their respective end.

FIG. 20 illustrates a heat exchanger variant having a further, box-shaped tube head 48 designed as a hot air flow deflector, from which the compressed air, having been preheated in its passage through a first matrix portion M1, is again directed to a second matrix portion M2, which extends essentially in parallel with the first matrix portion and which communicates with the respective tubesheet of teh tube head 49. From this last-mentioned tube head 49 the compressed air, having been heated in its passage through the two matrix portions M1 and M2, is directed to a suitable consumer. FIG. 20, in departure from FIG. 19, also gives the tube heads 44 and 49 a square shape, with the hot gas flow again being indicated by the letter G.

In a further heat exchanger intended for a preferred use shown in FIG. 21, the hot gas (G) wetted cross-/counterflow matrix M1, M2 may consist of separate tubes, or spear-shaped tubular shapes, analogous to FIG. 18, item 40. In accordance with FIG. 21, said tubular shapes can be connected at the one end to a stationary tube head 50 to supply compressed air D into the respective matrix ducts, and at the other end to a second stationary tube head 51, from which the compressed air, having been heated in its passage through matrix M1, M2, can be directed to a consumer. FIG. 21 also shows that the two separate heads 50, 51 are integrated into a common collective tube 52. FIG. 21 further shows that the respective heat exchanger matrix M1, M2 or their respective tubular shapes project laterally in U-fashion from the common collective tube 52.

With reference to FIG. 22, the compressor air D, for example, that delivered by a compressor of gas turbine engine omitted from the drawings, can be directed, through a tube line 54, to a first tube head 60, from which the compressed air D to be preheated will then flow into the tubular shapes of the matrix, e.g., M2, wetted by the hot gas stream. Having been heated, the compressed air, or the compressor air D', is directed into a further tube head 61, from which it is routed as combustion air to the combustion chamber of said gas turbine engine through a tube line 55. FIG. 22, therefore, departs from FIG. 21 primarily by the use of two separate parallel tube lines 60, 61 in lieu of a single collective tube, wherein correspondence with FIG. 21 another portion of the matrix in FIG. 22 is analogously indicated by M1.

While I have shown and described several embodiments in accordance with the present invention, it is understood that the same is not limited thereto but is susceptible to numerous changes and modifications as known to one having ordinary skill in the art, and I therefore do not wish to be limited to the details shown and described herein, but intend to cover all such modifications as are encompassed by the scope of the appended claims.

I claim:

1. A heat exchanger for gases of greatly different temperatures wherein the cross and counterflow matrix to be exposed to the hot gas stream consists of a plurality of tubes of spear-shaped cross-sectioned tubular shapes having in cross-section a first dimension along a first direction and a second dimension less than said first dimension along a second direction substantially orthogonal to said first direction and formed to promote flow in a direction taken by the hot gas, said tubes being connected to at least one tubesheet which forms part of a tubular head designed to permit the entry and exit of a medium to and from the matrix, wherein (a) the at least one tubesheet comprises layers;

(b) each layer comprises a row of heat exchanger matrix tubular shapes corresponding to said tubes and having first dimensions extending substantially in said first direction;

(c) each layer comprises two complementary sheet metal shells;

(d) the sheet metal shells preformed at least such that when joined together to form a layer, the sheet metal shells form adjacent wall sections and said matrix tubular shapes, and (e) the sheet metal shells of a layer form between them recesses on the inner side of the tubesheet, said recesses communicate with said tubular shapes and extend in said first and said second directions.

2. A heat exchanger as set forth in claim 1, wherein the layers and the respective sheet metal shells are arranged and formed such that with the heat exchanger tubesheets joined together, flow-promoting pointed ends of a first row of matrix tubular shapes oriented with said first dimension in said first direction of the tubes extend to points located between adjacent, specialsection ends of another row of shapes oriented in the first direction of the tubes.

3. A heat exchanger as set forth in claim 1, wherein the respective outer wall sections adjoining the matrix comprise said recesses of two sheet metal shells of a layer designed for attachment one to the other and also for retaining and orienting the locally entering connecting ends of the matrix tubular shapes.

4. A heat exchanger of claim 1, wherein the inner wall sections of the respective complementary sheet metal shells extending in the said first direction of the layer and including at least part of the recesses on the inner side of the tubesheet form mating attaching surfaces for an adjacent second layer.

5. A heat exchanger of claim 1, wherein transitional sections of the respective two complementary of shells arranged between the outer wall sections of two sheet metal shells of a layer and the inner wall sections take one of an inclined and a moderately curved form to define the spatial width of a layer.

6. A heat exchanger as set forth in claim 1, wherein the metal sheet shells are provided with suitable surface contour means for increasing structural strength and thermal transmission.

7. A heat exchanger as set forth in claim 1, wherein one of the inner wall sections of the sheet metal shells of the respective layers on the inner side of the tubesheet has a corrugated surface corresponding to the contour of the matrix tubular shapes.

8. A heat exchanger as set forth in claim 7, wherein a throat area caused by the corrugation surface is bridged by a material-based or bonding-type joint.

9. A heat exchanger as set forth in claim 1, wherein the inner wall sections of the respective sheet metal shells of the layers have a periodically angled joining contour in the immediate vicinity of respective matrix shape end areas.

10. A heat exchanger as set forth in claim 1, wherein the transitional sections of the respective sheet metal shells between outer and the inner wall sections are bent at a sharp angle where the outer wall sections have cutouts in at least those areas that lie between two matrix root shape elements of a first layer, and adjoin a matrix root shape element of an adjacent layer.

11. A heat exchanger as set forth in claim 10, wherein sheet metal flanges to reinforce the walls are formed on the respective inner radius or lower rim of the cutouts.

12. A heat exchanger as set forth in claim 1, wherein each layer forms part of a closed-circumference frame, and the layers are joined to form a complete container, the circumference of which is represented by said frame.

13. A heat exchanger as set forth in claim 12, wherein the container so formed is one of square, polygonal and circular in cross section.

14. A heat exchanger as set forth in claim 1, wherein the outer wall sections of the sheet metal shells are fitted with matrix shape connectors which are.substantially tangential with respect to the cross section of the matrix shapes for connection of at least one matrix shape into the heat exchanger tubesheet.

15. A heat exchanger as set forth in claim 12, wherein a layer extends in screw thread fashion in accordance with the intended circumference of the container shell and in this manner, the inner wall sections of the layer, repeating themselves thread for thread, are arranged side by side and joined together to form a container shell.

16. A heat exchanger as set forth in claim 1, wherein the lower wall sections, projecting on the inner side of the heat exchanger tubesheet and abutting one on the other have webs are joined together by jointly fusing the associated ends of the webs.

17. A heat exchanger as set forth in claim 1, wherein the heat exchanger tubesheet forms part of the shell of a pressure vessel, wherein the hydraulic forces of an end cover of the vessel are absorbed by means comprising one of a rod frame construction and the wall of a separate heat exchanger housing.

18. A heat exchanger as set forth in claim 14, wherein each of the plurality of tubes is connected to the connectors of the sheet metal shells of the heat exchanger tubesheet by brutt welds.

19. A heat exchanger as set forth in claim 1, wherein the connection of two complementary shells of a layer one to the other and of the layers one to the other is made by butt welds.

20. A heat exchanger as set forth in claim 1, wherein the tubular matrix shapes have an angled contour in a central area between two tubular heads for added flexibility in bending and for introduction of compressed air into the matrix and for exhaust of hot air from the matrix.

21. A heat exchanger as set forth in claim 1, wherein the cross and counterflow matrix in the hot gas stream comprises separate spear-shaped cross-sectioned tubular shapes connected at the one end to a first stationary tubular head means for the introduction of compressed air into the respective matrix ducts and at the other end, to a second stationary tubular head means for carrying the compressed air heated by the matrix to a consumer and wherein the two separate heads are integrated into a common collective tube and wherein the heat exchanger matrix projects laterally in U-shape fashion from the respective tubes.

22. A heat exchanger as set forth in claim 20, wherein the tubular head serving to exhaust the hot air is designed as a hot air flow deflector, from which the compressed air heated by the first matrix portion is introduced again into another matrix portion running essentially parallel with the first matrix portion, said second matrix portion being connected to the respective heat exchanger tubesheet of a tubular head, from which the compressed air heated by the two matrix portions is ducted to a consumer.

23. A heat exchanger as set forth in claim 1, wherein the cross/counterflow matrix in the hot gas stream comprises separate spear-shaped cross-sectioned tubular shapes connected at the one end to a first stationary tubular head means for the introduction of compressed air into the respective matrix ducts and at the other end, to a second stationary tubular head means for carrying the compressed air heated by the matrix to a consumer, and wherein the two separate heads are formed by substantially parallel individual tubes arranged side by side, and wherein the heat exchanger matrix projects laterally in U-shape fashion from the respective tubes.

* * * * *